US006379506B1

(12) United States Patent
Wilson et al.

(10) Patent No.: US 6,379,506 B1
(45) Date of Patent: Apr. 30, 2002

(54) AUTO-JOINABLE TRIPLE LAYER PAPERMAKER'S FORMING FABRIC

(75) Inventors: Robert G. Wilson, Wake Forest, NC (US); Kevin John Ward, Nova Scotia (CA)

(73) Assignee: Weavexx Corporation, Wake Forest, NC (US)

( * ) Notice: Subject to any disclaimer, the term of this patent is extended or adjusted under 35 U.S.C. 154(b) by 0 days.

(21) Appl. No.: 09/679,766

(22) Filed: Oct. 5, 2000

(51) Int. Cl.[7] ..... D21F 1/16; D03D 3/04

(52) U.S. Cl. ..... 162/348; 162/903; 139/383 A; 139/425 A; 442/203; 442/205

(58) Field of Search ..... 162/306, 348, 162/358.2, 358.4, 900, 902, 903, 145; 139/383 A, 425 A, 383 AA; 442/181, 320, 203, 239, 326, 240, 205, 206, 207; 428/224; 34/116; 245/2

(56) References Cited

U.S. PATENT DOCUMENTS

| | | | | | |
|---|---|---|---|---|---|
| 4,283,454 | A | * | 8/1981 | Buchanan | 442/215 |
| 4,359,501 | A | * | 11/1982 | DiTullio | 442/229 |
| 4,376,455 | A | * | 3/1983 | Hahn | 139/383 A |
| 4,501,303 | A | * | 2/1985 | Osterberg | 139/425 A |
| 4,515,853 | A | | 5/1985 | Borel | 428/257 |
| 4,518,644 | A | * | 5/1985 | Vuorio | 428/198 |
| 4,564,052 | A | * | 1/1986 | Borel | 139/425 A |
| 4,592,396 | A | | 6/1986 | Borel et al. | 139/425 |
| 4,605,585 | A | | 8/1986 | Johansson | 428/224 |
| 4,636,426 | A | | 1/1987 | Fleischer | 428/224 |
| 4,934,414 | A | | 6/1990 | Borel | 139/383 |
| 4,967,805 | A | | 11/1990 | Chiu et al. | 139/383 |
| 4,987,929 | A | | 1/1991 | Wilson | 139/383 |
| 5,025,839 | A | * | 6/1991 | Wright | 139/383 A |
| 5,158,118 | A | | 10/1992 | Tate et al. | 139/383 |
| 5,518,042 | A | | 5/1996 | Wilson | 139/383 |
| 5,709,250 | A | | 1/1998 | Ward et al. | 139/383 |
| 5,826,627 | A | | 10/1998 | Seabrook et al. | 139/383 |
| 5,881,764 | A | * | 3/1999 | Ward | 139/383 A |
| 5,967,195 | A | | 10/1999 | Ward | 139/383 |
| 5,983,953 | A | | 11/1999 | Wilson | 139/383 |

OTHER PUBLICATIONS

Weavexx Product Sheet 2850 IX3 "Admitted Prior Art".
Weavexx Product Sheet Vantage 16T "Admitted Prior Art".

* cited by examiner

*Primary Examiner*—Peter Chin
*Assistant Examiner*—Eric Hug
(74) *Attorney, Agent, or Firm*—Myers Bigel Sibley & Sajovec

(57) ABSTRACT

Auto-joinable triple layer papermaker's forming fabrics which exhibit relatively low caliper values, good mechanical stability, and relatively high permeability. In one embodiment of the present invention, triple layer papermaker's forming fabrics having both top and bottom sets of machine direction and cross machine direction yarns are provided in which each yarn in the set of bottom machine directions yarns alternatively pairs with the two yarns in the set of bottom machine direction yarns that are woven immediately adjacent to it.

40 Claims, 6 Drawing Sheets

AUTO-JOINABLE TRIPLE LAYER PAPERMAKER'S FORMING FABRIC

FIELD OF THE INVENTION

The present invention relates generally to papermaking, and relates more specifically to forming fabrics employed in papermaking.

BACKGROUND OF THE INVENTION

In the conventional fourdrinier papermaking process, a water slurry, or suspension, of cellulosic fibers (known as the paper "stock") is fed onto the top of the upper run of an endless belt of woven wire and/or synthetic material that travels between two or more rolls. The belt, often referred to as a "forming fabric," provides a papermaking surface on the upper surface of its upper run which operates as a filter to separate the cellulosic fibers of the paper stock from the aqueous medium, thereby forming a wet paper web. The aqueous medium drains through mesh openings of the forming fabric, known as drainage holes, by gravity or vacuum located on the lower surface of the upper run (i.e., the "machine side") of the fabric.

After leaving the forming section, the paper web is transferred to a press section of the paper machine, where it is passed through the nips of one or more pairs of pressure rollers covered with another fabric, typically referred to as a "press felt." Pressure from the rollers removes additional moisture from the web; the moisture removal is often enhanced by the presence of a "batt" layer of the press felt. The paper is then transferred to a dryer section for further moisture removal. After drying, the paper is ready for secondary processing and packaging.

Typically, papermaker's fabrics are manufactured as endless belts by one of two basic weaving techniques. In the first of these techniques, fabrics are flat woven by a flat weaving process, with their ends being joined to form an endless belt by any one of a number of well-known joining methods, such as dismantling and reweaving the ends together (commonly known as splicing), or sewing on a pin-seamable flap or a special foldback on each end, then reweaving these into pin-seamable loops. A number of auto-joiner machines are now commercially available, which for certain fabrics may be used to automate at least part of the joining process. In a flat woven papermaker's fabric, the warp yarns extend in the machine direction and the filling yarns extend in the cross machine direction.

In the second basic weaving technique, fabrics are woven directly in the form of a continuous belt with an endless weaving process. In the endless weaving process, the warp yarns extend in the cross machine direction and the filling yarns extend in the machine direction. As used herein, the terms "machine direction" (MD) and "cross machine direction" (CMD) refer, respectively, to a direction aligned with the direction of travel of the papermakers' fabric on the papermaking machine, and a direction parallel to the fabric surface and traverse to the direction of travel. Both weaving methods described hereinabove are well known in the art, and the term "endless belt" as used herein refers to belts made by either method.

Effective sheet and fiber support marking are important considerations in papermaking, especially for the forming section of the papermaking machine, where the wet web is initially formed. Additionally, the forming fabrics should exhibit good stability when they are run at high speeds on the papermaking machines, and preferably are highly permeable to reduce the amount of water retained in the web when it is transferred to the press section of the paper machine. In both tissue and fine paper applications (i.e., paper for use in quality printing, carbonizing, cigarettes, electrical condensers, and like) the papermaking surface comprises a very finely woven or fine wire mesh structure.

Typically, finely woven fabrics such as those used in fine paper and tissue applications include at least some relatively small diameter machine direction or cross machine direction yarns. Regrettably, however, such yarns tend to be delicate, leading to a short surface life for the fabric. Moreover, the use of smaller yarns can also adversely affect the mechanical stability of the fabric (especially in terms of skew resistance, narrowing propensity and stiffness), which may negatively impact both the service life and the performance of the fabric.

To combat these problems associated with fine weave fabrics, multi-layer forming fabrics have been developed with fine-mesh yarns on the paper forming surface to facilitate paper formation and coarser-mesh yarns on the machine contact side to provide strength and durability. For exanple, fabrics have been constructed which employ one set of machine direction yarns which interweave with two sets of cross machine direction yarns to form a fabric having a fine paper forming surface and a more durable machine side surface. These fabrics form part of a class of fabrics which are generally referred to as "double layer" fabrics. Similarly, fabrics have been constructed which include two sets of machine direction yarns and two sets of cross machine direction yarns that form a fine mesh paperside fabric layer and a separate, coarser machine side fabric layer. In these fabrics, which are part of a class of fabrics generally referred to as "triple layer" fabrics, the two fabric layers are typically bound together by separate stitching yarns. However, they may also be bound together using yarns from one or more of the sets of bottom and top cross machine direction and machine direction yarns. As double and triple layer fabrics include additional sets of yarn as compared to single layer fabrics, these fabrics typically have a higher "caliper" (i.e., they are thicker) than comparable single layer fabrics. An illustrative double layer fabric is shown in U.S. Pat. No. 4,423,755 to Thompson, and illustrative triple layer fabrics are shown in U.S. Pat. No. 4,501,303 to Osterberg, U.S. Pat. No. 5,152,326 to Vohringer, and U.S. Pat. No. 5,437,315 to Ward.

Although these fabrics have generally performed successfully, they have some shortcomings. For instance, various multi-layer fabrics are not auto-joinable with currently available equipment. As noted above, auto-joining refers to an automated process whereby the two ends of a fabric woven in a flat-weaving process are joined to form a fabric woven in a continuous loop. However, auto-joining machines may not be used to join the two ends of a fabric if adjacent machine direction yarns follow the same weave path because the auto-joining machine may not be able to consistently separate such yarns correctly. If the adjacent yarns are paired, then the auto-joining machine may be unable to consistently select the correct yarn during the auto-join process, and instead may select both the correct yarn and the adjacent yarn. Thus, fabrics with paired machine directions yarns in a fabric layer are typically joined by a hand-weaving process, which is more expensive and time consuming than the auto-joining process.

SUMMARY OF THE INVENTION

The present invention relates to auto-joinable triple layer papermaker's forming fabrics which exhibit relatively low caliper values, good mechanical stability, and relatively high permeability.

In one embodiment of the present invention, triple layer papermaker's forming fabrics having both top and bottom sets of machine direction and cross machine direction yarns are provided in which each yarn in the set of bottom machine directions yarns alternatively pairs with the two yarns in the set of bottom machine direction yarns that are woven immediately adjacent to it. Such fabrics can be constructed so that at least some of the top machine direction yarns interweave with the bottom cross machine direction yarns to bind the top and bottom fabric layers together, or alternatively, may be constructed using a separate set of stitching yarns. If such separate stitching yarns are used, these yarns may be necessary to the formation of the top fabric layer or may be yarns that are separate from, but which weave with, the top fabric layer.

"In another embodiment of the present invention, the above-described triple layer forming fabrics may be woven so that each yarn in the set of bottom machine direction yarns weaves beneath half of the bottom cross machine direction yarns in each repeat of the fabric, and/or so that each bottom cross machine direction yarn is woven with the bottom machine direction yarns such that it passes over two adjacent bottom machine direction yarns and passes under the next two bottom machine direction yarns in a repeating pattern. In one specific implementation of this embodiment, half of the yarns in the set of bottom machine direction yarns are woven in a repeating pattern in which they pass over two adjacent bottom cross machine direction yarns, under the next two bottom cross machine direction yarns, over the next bottom cross machine direction yarn, under the next bottom cross machine direction yarn, over the next bottom cross machine direction yarn and under the next bottom cross machine direction yarn. In this implementation, the papermaking surface may be woven in a 1×3 twill pattern."

In yet another embodiment of the present invention, triple layer papermaker's forming fabrics having both top and bottom sets of machine direction and cross machine direction yarns are provided in which each yarn in the set of bottom machine directions yarns is woven with the bottom cross machine direction yarns in a zig-zag pattern. These fabrics may also incorporate a set of stitching cross machine direction yarns that bind the top and bottom fabric layers together, or alternatively may use yarns from the base fabric structures to perform such stitching. In this embodiment, each pair of adjacent yarns in the set of bottom machine direction yarns may be woven so that they together form a repeating series of hourglass patterns in the bottom fabric layer. The papermaking surface of the fabric may be woven in a variety of different weave patterns, specifically including 1×2, 1×3, 1×4, 2×2 and 2×3 twill patterns and a 1×1 plain weave pattern. The bottom machine direction yarns may be woven with the bottom cross machine direction yarns so as to include at least one single float and at least one double float machine direction knuckles on the bottom surface of the bottom fabric layer in each repeat of the fabric, and/or so that the bottom machine direction yarns weave beneath at least half of the bottom cross machine direction yarns.

In another aspect of the present invention, methods of using a triple layer papermaker's forming fabric for making paper are provided.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the illustrated or other embodiments set forth herein; rather, these embodiments are provided so that this disclosure will be thorough and complete, and will fully convey the scope of the invention to those skilled in the art. In the figures, the dimensions of some components may be exaggerated for clarity.

Pursuant to one aspect of the present invention, auto-joinable triple layer papermaker's forming fabrics include both a top fabric layer and a bottom fabric layer, and may use either self-stitching yarns or conventional stitching yarns to bind the fabric layers together. Pursuant to the teachings of the present invention, such fabrics may be constructed to have bottom MD yarns that are woven in a zig-zag pattern. Moreover, the zig-zag pattern may be set up so that each bottom MD yarn alternatively pairs with the two bottom MD yarns which are woven adjacent to it. Such a weave pattern in the bottom fabric layer may provide a fabric in which adjacent bottom machine direction yarns are partially stacked beneath a machine direction yarn in the top fabric layer, thereby providing for good permeability while providing separate machine direction yarn paths to allow the fabric to be auto-joined.

Figure 1:
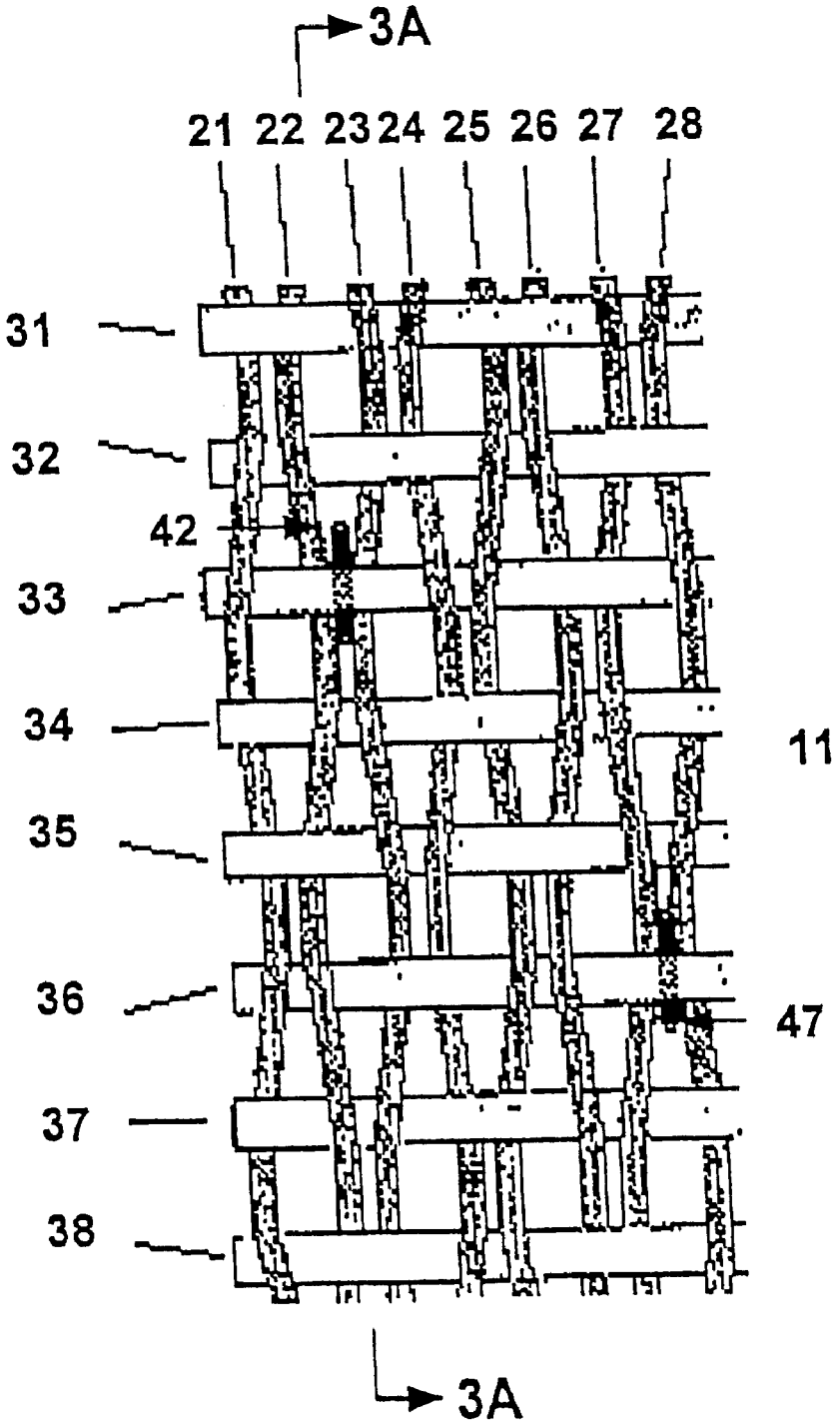
FIG. 1 is a top view of the bottom fabric layer of an embodiment of a 16 harness triple layer forming fabric of the present invention.
Figure 2:
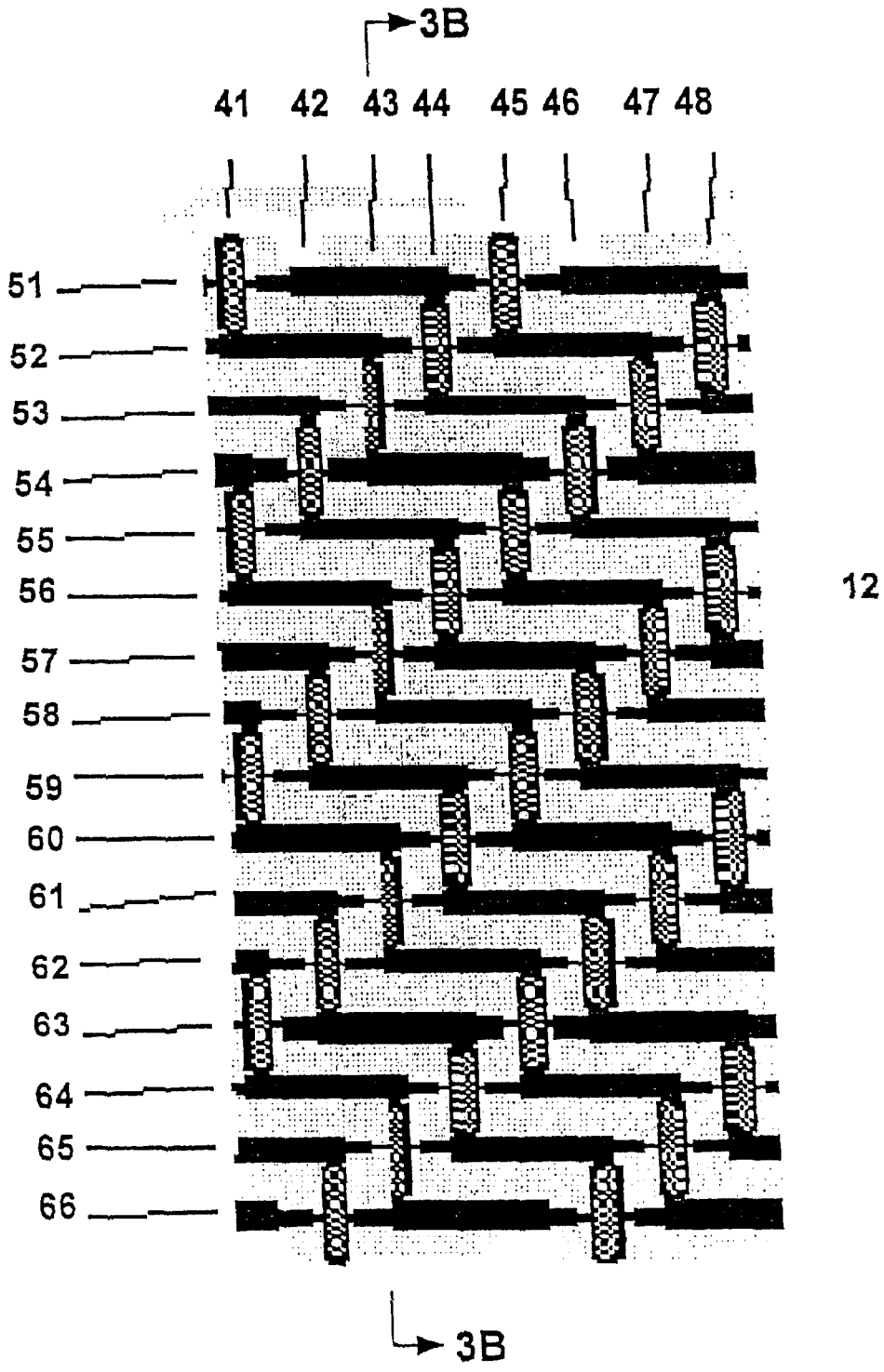
FIG. 2 is a top view of the top fabric layer of the triple layer forming fabric of FIG. 1.
Figure 3A:
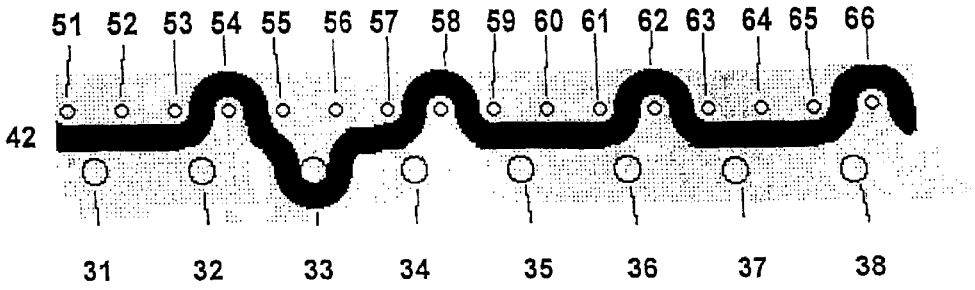
FIG. 3A is a cross-sectional view of the triple layer fabric depicted in FIGS. 1 and 2 taken along 3A—3A of FIG. 1.
Figure 3B:
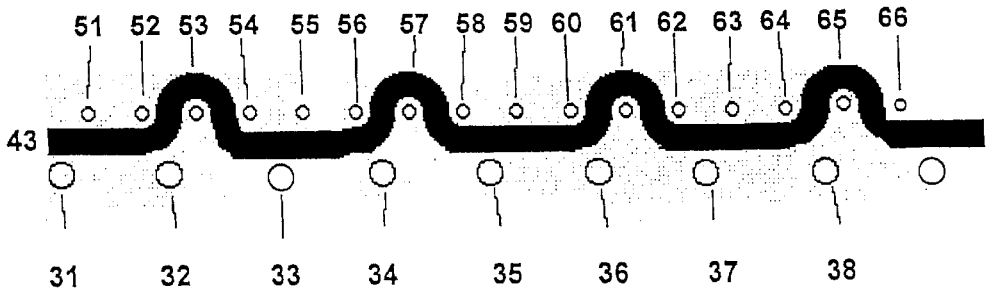
FIG. 3B is a cross-sectional view of the triple layer fabric depicted in FIGS. 1 and 2 taken along 3B—3B of FIG. 2.

One embodiment of the triple layer forming fabrics of the present invention is illustrated in FIGS. 1–3. FIG. 1 depicts a top view of the bottom fabric layer 11 of the triple layer fabric 10 (i.e., a view of the surface of the bottom fabric layer that does not contact the papermaking machine) while FIG. 2 depicts a top view of the top fabric layer 12 of fabric 10 (i.e., a view looking down onto the papermaking surface). FIG. 3A depicts a cross-sectional view of the fabric of FIGS. 1 and 2 taken along the lines 3A—3A in FIG. 1, and FIG. 3B depicts a cross-sectional view of the fabric of FIGS. 1 and 2 taken along the lines 3B—3B in FIG. 2. The triple layer fabric 10 of FIGS. 1–3 is woven on 16 harnesses, and hence a single repeat of the fabric encompasses eight top layer machine direction yarns and eight bottom layer machine direction yarns. While FIGS. 1 and 2 only show a single repeat unit of the fabric, those of skill in the art will appreciate that in commercial applications the repeat unit shown in FIGS. 1 and 2 would be repeated many times, in both the machine and cross machine directions, to form a large fabric suitable for use on a papermaking machine.

As seen in FIG. 1, the repeat unit of the fabric 10 includes a set of bottom layer MD yarns 21–28 and a set of bottom layer CMD yarns 31–38. These yarns 21–28 and 31–38 are interwoven such that each yarn in the set of bottom layer CMD yarns 31–38 alternatively passes over two and then under two of the yarns in the set of bottom layer MD yarns 21–28. For example, bottom CMD yarn 31 passes over bottom MD yarns 21–22, under bottom MD yarns 23–24, over bottom MD yarns 25–26, and under bottom MD yarns 27–28. Similarly, bottom CMD yarn 32 passes under bottom MD yarns 21–22, over bottom MD yarns 23–24, under bottom MD yarns 25–26, and over bottom MD yarns 27–28.

"As is also shown in FIG. 1, bottom layer MD yarns 21, 22, 25 and 26 weave with the bottom layer CMD yarns 31–38 in an under 1/over 2/under 2/over 1/under 1/over 1 pattern. Thus, for example, bottom MD yarn 21 passes under bottom CMD yarn 31, over bottom CMD yarns 32–33, under bottom CMD yarns 34–35, over bottom CMD yarn 36, under bottom CMD yarn 37 and over bottom CMD yarn 38. Bottom MD yarn 22 is woven with the bottom CMD yarns 31–38 in the same pattern as bottom MD yarn 21, except that the pattern is offset by 4 bottom CMD yarns (i.e., the under 1/over 2/under 2/over 1/under 1/over 1 pattern begins as bottom MD yarn 22 passes under bottom CMD yarn 35). Bottom MD yarns 23, 24, 27 and 28 weave with the bottom layer CMD yarns 31–38 in an over 1/under 2/over 2/under 1/over 1/under 1 pattern. Thus, for example, bottom MD yarn 23 passes over bottom CMD yarn 31, under bottom CMD yarns 32–33, over bottom CMD yarns 34–35, under bottom CMD yarn 36, over bottom CMD yarn 37 and under bottom CMD yarn 38. Bottom MD yarn 24 is likewise woven in the same pattern as bottom MD yarn 23, except that the pattern is offset by 4 bottom CMD yarns 31–38. Bottom MD yarns 25–28 are woven in a pattern with respect to the bottom CMD yarns 31–38 identical to bottom MD yarns 21–24, respectively."

Referring now to FIG. 2, a repeat unit of the top fabric layer 12 of the fabric is shown. The repeat unit includes a set of top layer MD yarns 41–48 which are interwoven with a set of top layer CMD yarns 51–66. As shown in FIG. 2, the yarns comprising the set of top layer CMD yarns 51–66 are interwoven with the set of top layer MD yarns 41–48 in a 1×3 twill type pattern, meaning that each of the top layer CMD yarns 51–66 passes below one yarn in the set of top MD yarns 41–48, above the next three yarns in the set of top MD yarns 41–48, below the next yarn in the set of top MD yarns 41–48, and above the next three yarns in the set of top MD yarns 41–48. For example, top CMD yarn pair 51 passes below top MD yarn 41, above top MD yarns 42–44, below top MD yarn 45, and above top MD yarns 46–48. The other top fabric layer CMD yarns 52–66 follow a similar "over-three/under-one" weave pattern, although this pattern is offset by one top layer MD yarn for adjacent top layer CMD yarns 51–66. Thus, for example, top fabric layer CMD yarn 52 passes above top MD yarns 41–43 and 45–47, whereas adjacent top fabric layer CMD yarn 51 passes above top MD yarns 42–44 and 46–48. The 1×3 twill pattern on the papermaking surface typically provides for both a high open area and good fiber support in the cross machine direction.

In the fabric depicted in FIGS. 1 and 2, the top fabric layer 12 (pictured in FIG. 2) and the bottom fabric layer 11 (pictured in FIG. 1) are stitched together by the top MD yarns 41–48. In FIG. 2, the portions of top MD yarns 42 and 47 which weave with the bottom fabric layer 11 are depicted to show where those yarns pass beneath bottom CMD yarns 33 and 36, respectively. In the embodiment of FIGS. 1 and 2, only two top MD yarns (42 and 47 in the repeat shown in FIGS. 1 and 2) stitch with the bottom layer CMD yarns in a repeat of the fabric. However, it will be appreciated by those of skill in the art that additional stitch points may be included within each repeat of the fabric, and that either all, or only some, of the top MD yarns 41–48 may perform the stitching function.

FIG. 3A is a cross section taken along the line 3A—3A in FIG. 1 to show the path of top MD yarn 42. As shown in FIG. 3A, top layer MD yarn 42 travels under top layer CMD yarns 51–53, over top layer CMD yarn 54, under top layer CMD yarns 55–57, over top layer CMD yarn 58, under top layer CMD yarns 59–61, over top layer CMD yarn 62, under top layer CMD yarns 63–65, and over top layer CMD yarn 66. As is also shown in FIG. 3A, top MD yarn 42 passes under bottom CMD yarn 33. In this manner, top layer MD yarn 42 serves to stitch the top fabric layer 12 and the bottom fabric layer 11 together. As noted above, each of the top MD yarns 41–48 follow the same weave pattern as indicated for yarn 42 in FIG. 3A, although the weave pattern is offset by one some number of top CMD yarns 51–66. As also noted above, not all of the top MD yarns 41–48 need drop to the bottom of the fabric 10 to stitch with a bottom CMD yarn 31–38.

FIG. 3B is a cross section taken along the line 3B—3B in FIG. 2 to show the path of top MD yarn 43. As shown in FIG. 3B, top layer MD yarn 43 travels under top layer CMD yarns 51–52, over top layer CMD yarn 53, under top layer CMD yarns 54–56, over top layer CMD yarn 57, under top layer CMD yarns 58–60, over top layer CMD yarn 61, under top layer CMD yarns 62–64, over top layer CMD yarn 65, and under top layer CMD yarn 66. As is also shown in FIG. 3B, top MD yarn 43 does not stitch with any of the bottom yarns in the repeat of the fabric pictured.

As noted above, top MD yarns 42 and 47 stitch with the bottom CMD yarns 33 and 36, respectively. This is best illustrated in FIG. 1, which shows the location where top MD yarns 42 and 47 descend to the bottom fabric layer 11. As shown in FIG. 1, top MD yarns 42 and 47 each stitch with the bottom fabric layer 11 at locations between two paired bottom CMD yarns. Thus, for example, top MD yarn 42 stitches with the bottom fabric layer 11 on bottom CMD yarn 33 between two paired bottom MD yarns, namely yarns 22 and 23. By configuring the weave so that the top MD yarns that stitch with the bottom fabric layer 11 do so between two bottom MD yarns that are paired, less of the top MD yarns contact the papermaking machine, which serves to protect them from premature wear.

As is best shown in FIG. 1, the bottom MD yarns 21–28 each weave in a zig-zag pattern. In the bottom layer fabric 11 of FIG. 1, the zig-zag pattern is configured such that each bottom MD yarn 21–28 alternatively pairs with the bottom MD yarns 21–28 that are adjacent to it on each side. Thus, for example, bottom MD yarn 22 pairs with bottom MD yarn 21 in the vicinity of bottom CMD yarns 31–32 and 35–36, while it pairs with bottom MD yarn 23 in the vicinity of bottom CMD yarns 33–34 and 37–38. Such a pairing arrangement may be beneficial in certain applications because, as best seen in FIG. 1, a relatively large drainage hole is provided adjacent each location where two adjacent bottom MD yarns 21–28 pair. These larger drainage holes may, in many applications, serve to facilitate drainage of water from the fabric 10. Moreover, by having each bottom MD yarn 21–28 alternatively pair with the bottom MD yarns on either side of it facilitates auto-joining. Accordingly, the fabric of FIGS. 1–3 may be auto-joined, yet still provides the advantages in reduced caliper, improved stability and improved permeability that accrue by providing paired bottom MD yarns.

As is also shown in FIG. 1, the bottom MD yarns 21–28 pair with an adjacent bottom MD yarn at the locations where the adjacent bottom MD yarns 21–28 both pass over the same bottom CMD yarn 31–38 and then under the next bottom CMD yarn 31–38. Thus, for example, bottom MD yarns 23 and 24 pair in the vicinity of bottom CMD yarns 31–32 and again pair in the vicinity of bottom CMD yarns 35–36. Both bottom MD yarns 23 and 24 pass over bottom CMD yarn 31 and under bottom CMD yarn 32. Likewise, both bottom MD yarns 23 and 24 pass over bottom CMD yarn 35 and under bottom CMD yarn 36. Also note that each bottom MD yarn 21–28 pairs twice with each of the two bottom MD yarns 21–28 that are adjacent to it in each repeat of the fabric. Thus, for example, bottom MD yarn 23 pairs with bottom MD yarn 24 in the vicinity of bottom CMD yarns 31–32 and 35–36, and pairs with bottom MD yarn 22 in the vicinity of bottom CMD yarns 33–34 and 37–38.

Figure 4:
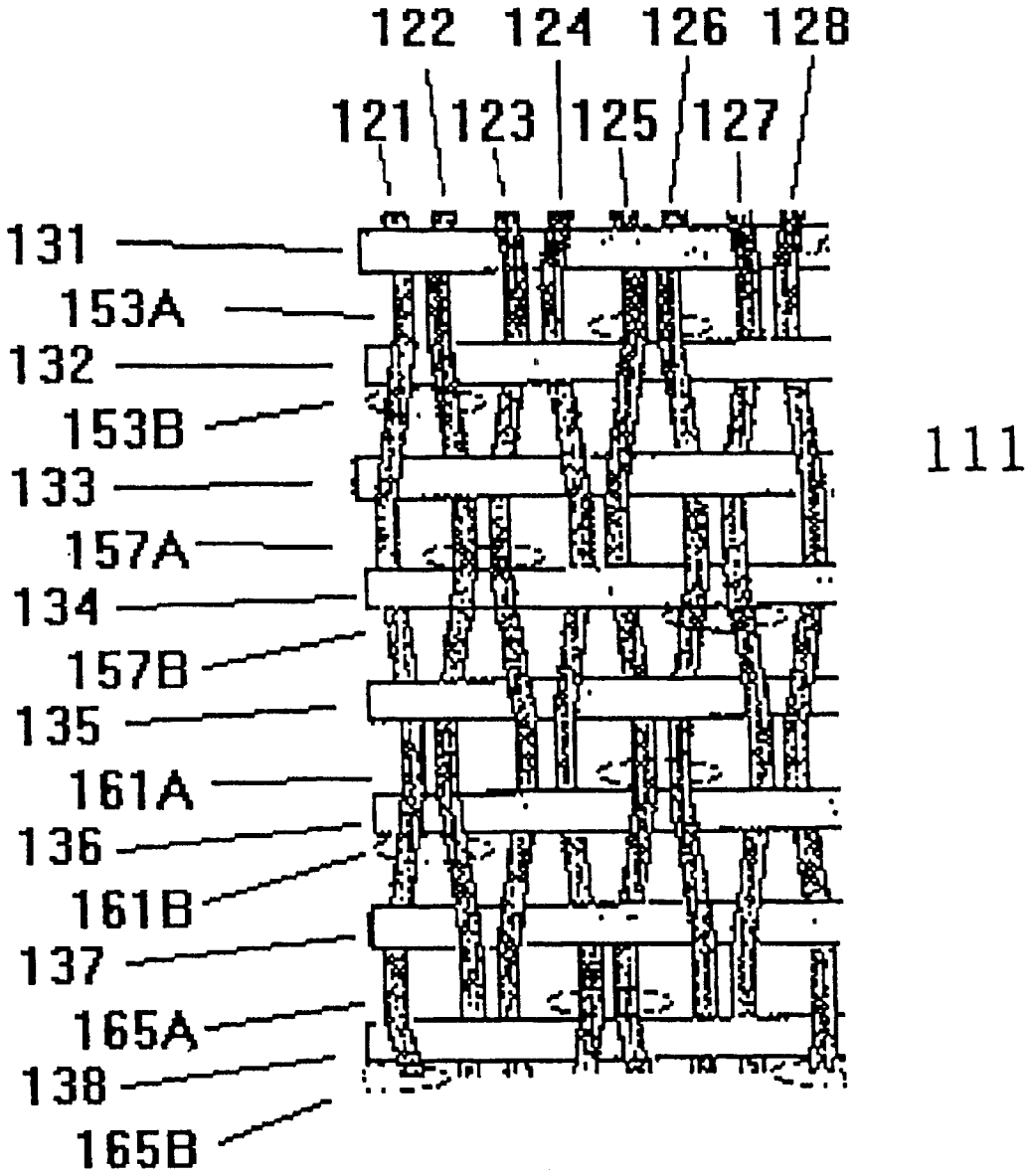
FIG. 4 is a top view of the bottom fabric layer of an alternative embodiment of a 16 harness triple-layer forming fabric of the present invention.
Figure 5:
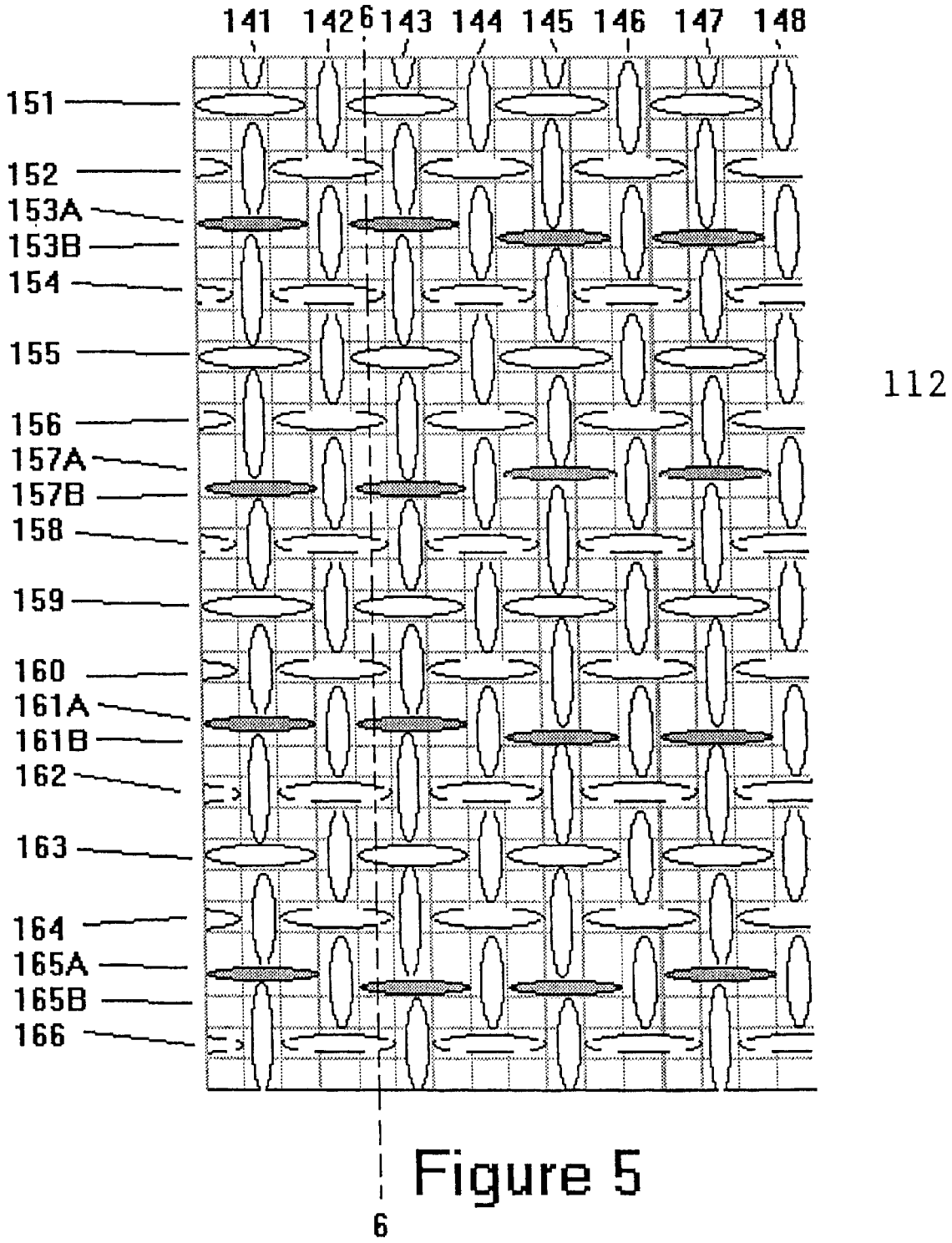
FIG. 5 is a top view of the top fabric layer of the triple layer forming fabric of FIG. 4.
Figure 6:
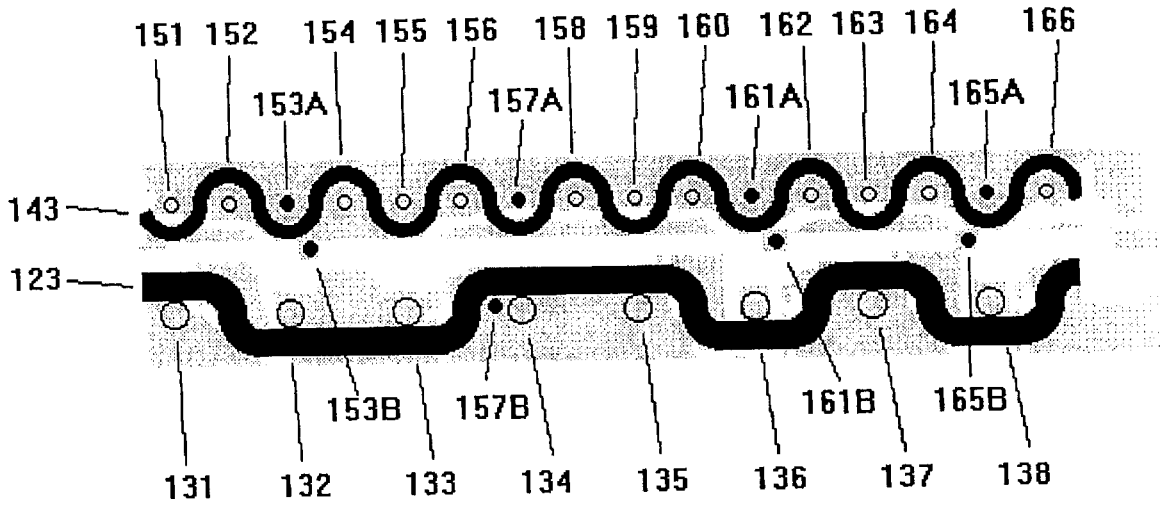
FIG. 6 is a cross-sectional view of the triple layer fabric depicted in FIGS. 4 and 5 taken along 6—6 of FIG. 5.

Another fabric 100 constructed according to the teachings of the present invention is illustrated in FIGS. 4–6. FIG. 4 depicts a top view of the bottom fabric layer 111 of the triple layer fabric 100 (i.e., a view of the surface of the bottom fabric layer that does not contact the papermaking machine) while FIG. 5 depicts a top view of the top fabric layer 112 of fabric 100 (i.e., a view looking down onto the papermaking surface). FIG. 6 is a cross sectional view of the fabric taken along the line 6—6 in FIG. 5. The triple layer fabric of FIGS. 4–6 is woven on 16 harnesses, and hence a single repeat of the fabric encompasses eight top layer machine direction yarns and eight bottom layer machine direction yarns.

As shown in FIG. 4, fabric 100 includes a bottom fabric layer 111 that comprises a set of bottom MD yarns 121–128 and a set of bottom CMD yarns 131–138. As is apparent from FIG. 4, the bottom fabric layer 111 is woven in the same pattern as the bottom fabric layer 11 of fabric 10, which is depicted in FIG. 1 and described above.

Referring now to FIG. 5, a repeat unit of the top fabric layer 112 of the fabric 100 is shown. The repeat unit of top fabric layer 112 includes a set of top layer MD yarns 141–148 which are interwoven with a set of top layer CMD yarns 151–166. As shown in FIG. 5, the yarns comprising the set of top layer CMD yarns 151–166 are interwoven with the set of top layer MD yarns 141–148 in a 1×1 or "plain weave" pattern, meaning that each of the top layer CMD yarns 151–166 alternatively pass below one yarn, and then above one yarn, in the set of top MD yarns 141–148. For example, top CMD yarn 151 passes above top MD yarn 141, below top MD yarn 142, above top MD yarn 143, below top MD yarn 144, above top MD yarn 145, below top MD yarn 146, above top MD yarn 147, and below top MD yarn 148. The other top fabric layer CMD yarns 152–166 follow an identical "over one/under one" pattern, although this pattern is offset by one top layer MD yarn for adjacent top layer CMD yarns 151–166.

As indicated in FIG. 5, various of the top layer CMD yarns (specifically yarns 153, 157, 161 and 165) comprise two separate yarns which are designated, by way of example, as yarns 153A and 153B in the case of "yarn" 153. Thus, yarns 153A and 153B together appear as a single yarn in the top fabric layer 112 that is woven with the top layer MD yarns 141–148 in a plain weave pattern.

In the fabric depicted in FIGS. 4–6, the top fabric layer 112 (pictured in FIG. 5) and the bottom fabric layer 111 (pictured in FIG. 4) are stitched together by the pairs of top layer CMD yarns 153A, 153B; 157A, 157B; 161A, 161B; 165A, 165B. Herein, the top layer CMD yarn pairs 153A, 153B; 157A, 157B; 161A, 161B; 165A, 165B are referred to as "DPS" top layer CMD yarns, and the remaining top layer CMD yarns 151–152, 154–156, 158–160, 162–164 and 166 are referred to as regular top layer CMD yarns. As best seen in FIG. 5, the DPS top layer CMD yarns are provided after every third regular top layer CMD yarn.

FIG. 6 is a cross-sectional view of fabric 100 which illustrates the path of top layer MD yarn 143 and bottom layer MD yarn 123 through the fabric. The cross-section of FIG. 6 is taken along the line 6—6 in FIG. 5. As shown in FIG. 6, top layer MD yarn 143 weaves with the top CMD layer yarns 151–166 in an over-one-under-one pattern which is part of the plain weave top fabric surface. As is also shown in FIG. 6, bottom layer MD yarn 123 weaves in an over one, under two, over two, under one, over one, under one pattern with respect to the bottom layer CMD yarns 131–138 as described previously with respect to FIG. 4.

As shown in FIG. 6, at selected intervals the one of a pair of DPS top layer CMD yarns drops down to the bottom fabric layer to weave with a bottom layer MD yarn. Specifically, in FIG. 6, the DPS top layer CMD yarn 157B weaves under bottom layer MD yarn 123 to stitch the top fabric layer and the bottom fabric layer together. Each of the other DPS top layer CMD yarns drop down to interweave with the bottom fabric layer at other points in the fabric. In the fabric of FIGS. 4–6, a given DPS top layer CMD yarn (e.g., yarn 153A or 153B) interlaces with the bottom fabric layer 111 once every eight bottom layer MD yarns. Additional details regarding the stitching of the top and bottom fabric layers is provided in FIG. 4. As shown in FIG. 4, when a DPS top layer CMD yarn interlaces with the bottom fabric layer 111, it passes beneath two adjacent bottom layer MD yarns 121–128. Thus, for example, the DPS top layer CMD yarn 153A passes beneath bottom layer MD yarns 125 and 126.

As is also illustrated in FIG. 4, the pairs of DPS top layer CMD yarns are woven such that they interlace with the bottom fabric layer 112 on opposite sides of a bottom layer CMD yarn. Thus, for example, the DPS top layer CMD yarns 153A and 153B interweave on opposite sides of bottom layer CMD yarn 132. Such an interlacing pattern may improve the performance of the fabric in certain fabric designs.

Those of skill in the art will appreciate that the DPS top layer CMD yarns may be included after every third regular top layer CMD yarn as in the fabric of FIGS. 4–6, or may be included at other intervals, such as, for example, after every first, second, fourth or fifth regular top layer CMD yarn. Those of skill in the art will also appreciate that the frequency of interlacing can be varied from that shown in the fabric of FIGS. 4–6. However, the stitching yarns should sufficiently bind the upper and lower fabric layers together to prevent excessive movement between the fabric layers, as such excessive movement could result in severe inter-layer wear problems. As will also be understood by those of skill in the art, in some applications it may be possible to use a set of machine direction stitching yarns as opposed to the DPS top layer CMD yarns that are discussed above.

In each of the pictured embodiments of the present invention (see FIGS. 1 and 4), each of the bottom MD yarns 21–28; 121–128 weave below half of the bottom CMD yarns. Pursuant to the teachings of the present invention it will be understood that this may be advantageous in certain applications because, among other things, it minimizes fabric caliper. Additionally, it will also be seen that in each of the pictured fabrics each bottom MD yarn 21–28; 121–128 is woven so that it does not pass under more than two consecutive bottom CMD yarns. Such a construction is beneficial in certain applications because, among other things, it protects the machine direction yarns from wear on the paper-making machine. However, it will be understood by those of skill in the art that in other applications it may be possible, or even preferable, to weave the fabric such that the bottom MD yarns weave under less than half of the bottom CMD yarns, or so that the bottom MD yarns weave under more than two consecutive bottom CMD yarns.

As noted above, pursuant to the teachings of the present invention, each yarn in the set of bottom machine direction yarns may be woven so that it alternatively pairs with the two yarns in the set of bottom machine direction yarns that are immediately adjacent to it. Thus, for example, as shown in FIG. 1, bottom MD yarn 22 alternates between pairing with bottom MD yarn 21 and bottom MD yarn 23. The fabric may be designed so that at the points where a bottom MD yarn pairs with an adjacent bottom MD yarn, the paired yarns are stacked beneath a top machine direction yarn. This may tend to provide good water drainage paths through the holes in the bottom fabric adjacent either side of the paired bottom MD yarns, as those holes tend to be relatively large, and tend to be located underneath a corresponding drainage hole in the top fabric layer. Thus, pursuant to the teachings of the present invention, it will be understood that fabrics may be provided that use partially paired yarns that are auto-joinable which still provide good fabric permeability characteristics.

Notably, in the bottom fabric layers 11, 111 of fabrics 10 and 100 (see FIGS. 1 and 4), respectively, the set of bottom MD yarns and the set of bottom CMD yarns form a machine-side surface having a combination of "single float" and "double float" machine direction knuckles. By a machine-side (or "bottom side") "single float" machine direction knuckle it is meant that when the bottom fabric layer is viewed from the top, no machine direction yarn passes under more than one consecutive cross machine direction yarn (such that the MD yarn is on the machine-side surface) before passing back to the top surface of the bottom fabric layer. Similarly, by a "double float" machine direction knuckle it is meant that when the bottom fabric layer is viewed from the top, no machine direction yarn passes under more than two consecutive cross machine direction yarns (such that the MD yarn is on the machine-side surface) before passing back to the top surface of the bottom fabric layer. In a preferred embodiment of the triple layer forming fabrics of the present invention, the bottom fabric layer is woven so as to have a machine side surface composed exclusively of "single float" and "double float" machine direction knuckles. Note that in determining whether or not a "knuckle" is a single float or double float knuckle, additional CMD stitching yarns are not counted in determining the number of consecutive CMD yarns under which the MD yarn floats.

In the embodiment of the bottom fabric layers 11, 111 depicted in FIGS. 1 and 4, each pair of adjacent bottom MD yarns form an "hourglass" pattern in the fabric. One such hourglass pattern is formed in each repeat of the fabric. By way of example, bottom MD yarns 21–22 (FIG. 1) form an hourglass having a top adjacent bottom CMD yarns 31–32, a mid-point adjacent bottom CMD yarns 35–36, and a bottom adjacent bottom CMD yarns 38–39 (with yarn 39 not depicted in FIG. 1). This hourglass pattern facilitates the alternative pairing of the bottom MD yarns, and also may help reduce the caliper of the fabric.

The fabrics pictured in FIGS. 1–3 and FIGS. 4–6 and otherwise described and claimed herein may be employed in a variety of applications, including forming fine paper grades, brown paper and newsprint, but is especially beneficial for tissue applications.

As will be appreciated by those of skill in the art, numerous modifications may be made to the fabrics pictured in FIGS. 1–3 and FIGS. 4–6 without deviating from the scope of the present invention. For instance, with respect to both of these embodiments of the present invention, a variety of different weave patterns may be employed in the top fabric layer, specifically including 1×1 plain weave, 1×2 twill, 2×2 twill, 1×3 and 1×4 twill papermaking surfaces, as well as various derivatives of the above-mentioned weave patterns, specifically including broken twill patterns such as those embodied in 4 or 5 harness satin single layer fabrics, which are known in the art as providing a good papermaking surface. Likewise, the fabrics may (generally) use either a "intrinsic" stitching yarns (i.e., yarns that form a substantial part of either the bottom or top fabric layers) or separate stitching yarns, and both cross machine direction and machine direction stitching yarns may be used. Similarly, both the number of stitching yarns and/or the frequency of the stitch points may be varied, as can the ratio of top-to-bottom machine direction and/or cross machine direction yarns. Thus, the scope of the present invention should be construed based on the claims appended hereto, as opposed to the illustrative examples of the claimed fabrics which are provided herein to fully enable those of skill in the art to practice the claimed invention.

The configurations of the individual yarns utilized in the fabrics of the present invention can vary, depending upon the desired properties of the final papermakers' fabric. For example, the yarns may be multifilament yarns, monofilament yarns, twisted multifilament or monofilament yarns, spun yarns, or any combination thereof. Also, the materials comprising yarns employed in the fabric of the present invention may be those commonly used in papermakers' fabric. For example, the yarns may be formed of polypropylene, polyester, nylon, or the like. The skilled artisan should select a yarn material according to the particular application of the final fabric.

Regarding yarn dimensions, the particular size of the yarns is typically governed by the size and spacing of the papermaking surface. In a typical embodiment of the triple layer fabrics disclosed herein, preferably the diameter of the top CMD yarns is between about 0.10 and 0.18 mm and the diameter of the top MD yarns is between about 0.10 and 0.18 mm. For these triple layer embodiments preferably the diameter of the bottom MD yarns is between about 0.10 and 0.18 mm, and the diameter of the bottom CMD yarns is between about 0.15 and 0.25 mm. The diameter of the stitching yarns (if separate stitching yarns are provided) is typically between about 0.10 and 0.15 mm. Those of skill in the art will appreciate that yarns having diameters outside the above ranges may be used in certain applications.

In one embodiment of the fabric depicted in FIGS. 1–3, the top MD yarns are 0.12 mm in diameter, while the top CMD yarns are 0.12 mm in diameter. The bottom MD yarns are 0.12 mm in diameter, and the bottom CMD yarns are 0.18 mm in diameter. This fabric may be implemented with nylon or polyester yarns, or with a combination thereof. Likewise, in one embodiment of the fabric depicted in FIGS. 4–6, the top MD yarns are 0.12 mm in diameter, while the top CMD yarns are 0.12 mm in diameter. The bottom MD yarns are 0.12 in diameter, and the bottom CMD yarns are 0.18 mm in diameter.

Pursuant to another aspect of the present invention, methods of making paper are provided. Pursuant to these methods, one of the exemplary papermaker's forming fabrics described herein is provided, and paper is then made by applying paper stock to the forming fabric and by then removing moisture from the paper stock. As the details of how the paper stock is applied to the forming fabric and how moisture is removed from the paperstock is well understood by those of skill in the art, additional details regarding this aspect of the present invention will not be provided herein.

The foregoing embodiments are illustrative of the present invention, and are not to be construed as limiting thereof. The invention is defined by the following claims, with equivalents of the claims to be included therein.

That which is claimed:

1. A triple layer papermaker's forming fabric comprising:

a set of top machine direction yarns and a set of top cross machine direction yarns which are interwoven to form a top fabric layer having a papermaking surface; and a set of bottom machine direction yarns and a set of bottom cross machine direction yarns which are interwoven to form a bottom fabric layer having a machine side surface;

wherein at least some of the top machine direction yarns also interweave with the bottom cross machine direction yarns to bind the top fabric layer and the bottom fabric layer together; and wherein each yarn in the set of bottom machine directions yarns alternatively pairs with the two yarns in the set of bottom machine direction yarns that are woven immediately adjacent to it.

2. The papermaker's fabric of claim 1, wherein each yarn in the set of bottom machine direction yarns weaves beneath at least half of the bottom cross machine direction yarns.

3. The papermaker's fabric of claim 2, wherein each yarn in the set of bottom machine direction yarns weaves beneath exactly half of the bottom cross machine direction yarns in each repeat of the fabric.

4. The papermaker's fabric of claim 1, wherein each yarn in the set of bottom machine direction yarns passes under no more than two adjacent bottom cross machine direction yarns.

5. The papermaker's fabric of claim 4, wherein each yarn in the set of bottom machine direction yarns is woven with the bottom cross machine direction yarns so as to include at least one single machine direction float and at least one double machine direction float on the bottom surface of the bottom fabric layer in each repeat of the fabric.

6. The papermaker's fabric of claim 1, wherein each bottom cross machine direction yarn is woven in a repeating pattern with the bottom machine direction yarns such that it passes over two adjacent bottom machine direction yarns and passes under the next two bottom machine direction yarns.

7. The papermaker's fabric of claim 1, wherein at least half of the yarns in the set of bottom machine direction yarns are woven in a repeating pattern in which they pass over two adjacent bottom cross machine direction yarns, under the next two bottom cross machine direction yarns, over the next bottom cross machine direction yarn, under the next bottom cross machine direction yarn, over the next bottom cross machine direction yarn and under the next bottom cross machine direction yarn.

8. The papermaker's fabric of claim 1, wherein the papermaking surface is woven in a 1×3 twill pattern.

9. The papermaker's fabric of claim 1, wherein the papermaking surface is woven in a 1×2 twill pattern.

10. The papermaker's fabric of claim 1, wherein the top machine direction yarns that interweave with the bottom cross machine direction yarns to bind the top fabric layer and the bottom fabric layer together do so between two bottom machine direction yarns that are substantially paired adjacent the point where the top machine direction yarn interweaves with the bottom cross machine direction yarn.

11. The papermaker's fabric of claim 1, wherein each yarn in the set of bottom machine direction yarns pairs with an adjacent bottom machine direction yarns at locations where the adjacent bottom machine direction yarns both pass over the same bottom cross machine direction yarn.

12. The papermaker's fabric of claim 1, wherein each yarn in the set of bottom machine direction yarns pairs with an adjacent bottom machine direction yarn at two separate locations in each repeat of the fabric.

13. A triple layer papermaker's forming fabric comprising:

a set of top machine direction yarns, a set of top cross machine direction yarns and a set of stitching cross machine direction yarns which are interwoven to form a top fabric layer having a papermaking surface; and a set of bottom machine direction yarns and a set of bottom cross machine direction yarns which are interwoven to form a bottom fabric layer having a machine side surface;

wherein the stitching cross machine direction yarns interweave with the top machine direction yarns and the bottom machine direction yarns to bind the top fabric layer and the bottom fabric layer together; and wherein each yarn in the set of bottom machine directions yarns is woven with the bottom cross machine direction yarns in a zig-zag pattern; and wherein each yarn in the set of bottom machine direction yarns weaves beneath at least half of the bottom cross machine direction yarns.

14. The papermaker's fabric of claim 13, wherein each pair of adjacent yarns in the set of bottom machine direction yarns are woven so that they together form a repeating series of hourglass patterns in the bottom fabric layer.

15. The papermaker's fabric of claim 13, wherein the papermaking surface is woven in a plain weave pattern.

16. The papermaker's fabric of claim 13, wherein the papermaking surface is woven in a 1×3 twill pattern.

17. The papermaker's fabric of claim 13, wherein the papermaking surface is woven in a 1×2 twill pattern.

18. The papermaker's fabric of claim 13, wherein at least some of the stitching yarns are woven as a pair of stitching yarns such that while one of the pair of stitching yarns weaves in the top fabric layer to complete the weave pattern in the top fabric layer, the other of the stitching yarns drops down into the bottom fabric layer to bind the top fabric layer and the bottom fabric layer together.

19. The papermaker's fabric of claim 18, wherein one pair of stitching cross machine direction yarns is provided for every top cross machine direction yarn.

20. The papermaker's fabric of claim 13, wherein each yarn in the set of bottom machine direction yarns pairs with an adjacent bottom machine direction yarn at locations where the adjacent bottom machine direction yarns both pass over the same bottom cross machine direction yarn.

21. The papermaker's fabric of claim 13, wherein each yarn in the set of bottom machine direction yarns pairs with an adjacent bottom machine direction yarn at two separate locations in each repeat of the fabric.

22. A triple layer papermaker's forming fabric comprising:

set of top machine direction yarns, a set of top cross machine direction yarns and a set of stitching cross machine direction yarns which are interwoven to form a top fabric layer having a papermaking surface; and a set of bottom machine direction yarns and a set of bottom cross machine direction yarns which are interwoven to form a bottom fabric layer having a machine side surface;

wherein the stitching cross machine direction yarns interweave with the top machine direction yarns and the bottom machine direction yarns to bind the top fabric layer and the bottom fabric layer together; and wherein each yarn in the set of bottom machine directions yarns is woven with the bottom cross machine direction yarns in a zig-zag pattern; and wherein each yarn in the set of bottom machine direction yarns is woven with the bottom cross machine direction yarns so as to include at least one single and at least one double float on the bottom surface of the bottom fabric layer in each repeat of the fabric.

23. The papermaker's fabric of claim 22, wherein each yarn in the set of bottom machine direction yarns is woven in a repeating pattern in which it passes over two adjacent bottom cross machine direction yarns, under the next two bottom cross machine direction yarns, over the next bottom cross machine direction yarn, under the next bottom cross machine direction yarn, over the next bottom cross machine direction yarn and under the next bottom cross machine direction yarn.

24. The papermaker's fabric of claim 22, wherein each bottom cross machine direction yarn is woven in a repeating pattern with the bottom machine direction yarns such that it passes over two adjacent bottom machine direction yarns and passes under the next two bottom machine direction yarns.

25. A triple layer papermaker's forming fabric comprising:

a set of top machine direction yarns, a set of top cross machine direction yarns and a set of stitching cross machine direction yarns which are interwoven to form a top fabric layer having a papermaking surface; and a set of bottom machine direction yarns and a set of bottom cross machine direction yarns which are interwoven to form a bottom fabric layer having a machine side surface;

wherein the stitching cross machine direction yarns interweave with the top machine direction yarns and the bottom machine direction yarns to bind the top fabric layer and the bottom fabric layer together; and wherein each yarn in the set of bottom machine directions yarns is woven with the bottom cross machine direction yarns in a zig-zag patteern; and wherein at least some of the stitching yarns are woven as a pair of stitching yarns such that while one of the pair of stitching yarns weaves in the top fabric layer to complete the weave pattern in the top fabric layer, the other of the stitching yarns drops down into the bottom fabric layer to bind the top fabric layer and the bottom fabric layer together; and wherein one pair of stitching cross machine direction yarns is provided for every third top cross machine direction yarn.

26. A triple layer papermaker's forming fabric comprising:

a set of top machine direction yarns, a set of top cross machine direction yarns and a set of stitching cross machine direction yarns which are interwoven to form a top fabric layer having a papermaking surface; and a set of bottom machine direction yarns and a set of bottom cross machine direction yarns which are interwoven to form a bottom fabric layer having a machine side surface;

wherein the stitching cross machine direction yarns interweave with the top machine direction yarns and the bottom machine direction yarns to bind the top fabric layer and the bottom fabric layer together; and wherein each yarn in the set of bottom machine directions yarns is woven with the bottom cross machine direction yarns in a zig-zag pattern; and wherein for at least some of the pairs of stitching cross machine direction yarns, one stitching yarn of the pair interlaces adjacent to one side of a bottom cross machine direction yarn and the other stitching yarn of the pair interlaces adjacent the opposite side of that bottom cross machine yarn.

27. A triple layer papermaker's forming fabric comprising:

a set of top machine direction yarns, a set of top cross machine direction yarns and a set of stitching cross machine direction yarns which are interwoven to form a top fabric layer having a papermaking surface; and a set of bottom machine direction yarns and a set of bottom cross machine direction yarns which are interwoven to form a bottom fabric layer having a machine side surface;

wherein the stitching cross machine direction yarns interweave with the top machine direction yarns and the bottom machine direction yarns to bind the top fabric layer and the bottom fabric layer together;

wherein each yarn in the set of bottom machine directions yarns is woven with the bottom cross machine direction yarns in a zig-zag pattern; and wherein the fabric is woven on 16 harnesses, and wherein every fourth bottom machine direction yarn is woven in the same pattern with respect to the bottom cross machine direction yarns.

28. A triple layer papermaker's forming fabric comprising:

a set of top machine direction yarns, a set of top cross machine direction yarns and a set of stitching cross machine direction yarns which are interwoven to form a top fabric layer having a papermaking surface; and a set of bottom machine direction yarns and a set of bottom cross machine direction yarns which are interwoven to form a bottom fabric layer having a machine side surface;

wherein the stitching cross machine direction yarns interweave with the top machine direction yarns and the bottom machine direction yarns to bind the top fabric layer and the bottom fabric layer together; and wherein each yarn in the set of bottom machine directions yarns alternatively pairs with the two yarns in the set of bottom machine direction yarns that are woven immediately adjacent to it.

29. The papermaker's fabric of claim 28, wherein each yarn in the set of bottom machine direction yarns weaves beneath at least half of the bottom cross machine direction yarns.

30. The papermaker's fabric of claim 28, wherein each yarn in the set of bottom machine direction yarns is woven with the bottom cross machine direction yarns so as to include at least one single machine direction float and at least one double machine direction float on the bottom surface of the bottom fabric layer in each repeat of the fabric.

31. The papermaker's fabric of claim 29, wherein each bottom cross machine direction yarn is woven in a repeating pattern with the bottom machine direction yarns such that it passes over two adjacent bottom machine direction yarns and passes under the next two bottom machine direction yarns.

32. The papermaker's fabric of claim 29, wherein the papermaking surface is woven in a 1×3 twill pattern.

33. A triple layer papermaker's forming fabric comprising:

a set of top machine direction yarns and a set of top cross machine direction yarns which are interwoven to form a top fabric layer having a papermaking surface;

a set of bottom machine direction yarns and a set of bottom cross machine direction yarns which are interwoven to form a bottom fabric layer having a machine side surface; and wherein at least some of the top machine direction yarns also interweave with the bottom cross machine direction yarns to bind the top fabric layer and the bottom fabric layer together; and wherein each yarn in the set of bottom machine directions yarns is woven with the bottom cross machine direction yarns in a zig-zag pattern;

wherein each yarn in the set of bottom machine direction yarns weaves beneath at least half of the bottom cross machine direction yarns.

34. The papermaker's fabric of claim 33, wherein each pair of adjacent yarns in the set of bottom machine direction yarns are woven so that they together form a repeating series of hourglass patterns in the bottom fabric layer.

35. The papermaker's fabric of claim 33, wherein the papermaking surface is woven in a plain weave pattern.

36. A triple layer papermaker's forming fabric comprising:

a set of top machine direction yarns and a set of top cross machine direction yarns which are interwoven to born a top fabric layer having a papermaking surface;

a set of bottom machine direction yarns and a set of bottom cross machine direction yarns which are interwoven to form a bottom fabric layer having a machine side surface; and wherein at least some of the top machine direction yarns also interweave with the bottom cross machine direction yarns to bind the top fabric layer and the bottom fabric layer together; and wherein each yarn in the set of bottom machine directions yarns is woven with the bottom cross machine direction yarns in a zig-zag pattern; and wherein each pair of adjacent yarns in the set of bottom machine direction yarns are woven so that they together form a repeating series of hourglass patterns in the bottom fabric layer; and wherein each yarn in the set of bottom machine direction yarns is woven with the bottom cross machine direction yarns so as to include at least one single and at least one double float on the bottom surface of the bottom fabric layer in each repeat of the fabric.

37. A triple layer papermaker's forming fabric comprising:

a set of top machine direction yarns and a set of top cross machine direction yarns which are interwoven to form a top fabric layer having a papermaking surface;

a set of bottom machine direction yarns and a set of bottom cross machine direction yarns which are interwoven to form a bottom fabric layer having a machine side surface; and wherein at least some of the top machine direction yarns also interweave with the bottom cross machine direction yarns to bind the top fabric layer and the bottom fabric layer together; and wherein each yarn in the set of bottom machine directions yarns is woven with the bottom cross machine direction yarns in a zig-zag pattern; and wherein each yarn in the set of bottom machine direction yarns is woven in a repeating pattern in which it passes over two adjacent bottom cross machine direction yarns, under the next two bottom cross machine direction yarns, over the next bottom cross machine direction yarn, under the next bottom cross machine direction yarn, over the next bottom cross machine direction yarn and under the next bottom cross machine direction yarn.

38. A method of making paper, said method comprising the steps of:

(a) providing a triple layer papermaker's fabric comprising:

a set of top machine direction yarns and a set of top cross machine direction yarns which are interwoven to form a top fabric layer having a papermaking surface; and a set of bottom machine direction yarns and a set of bottom cross machine direction yarns which are interwoven to form a bottom fabric layer having a machine side surface; and a set of stitching yarns that bind the top fabric layer and the bottom fabric layer together;

wherein each yarn in the set of bottom machine directions yarns alternatively pairs with the two yarns in the set of bottom machine direction yarns that are woven immediately adjacent to it, (b) applying paper stock to said papermaker's fabric; and (c) removing moisture from said paper stock.

39. The method of claim 38, wherein each pair of adjacent yarns in the set of bottom machine direction yarns are woven so that they together form a repeating series of hourglass patterns in the bottom fabric layer.

40. The method of claim 38, wherein each yarn in the set of bottom machine directions yarns is woven with the bottom cross machine direction yarns in a zig-zag pattern.

* * * * *

UNITED STATES PATENT AND TRADEMARK OFFICE

CERTIFICATE OF CORRECTION

PATENT NO. : 6,379,506 B1 
DATED : April 30, 2002
INVENTOR(S) : Wilson et al.

It is certified that error appears in the above-identified patent and that said Letters Patent is hereby corrected as shown below:

Column 15,
Line 38, should read as follows:
-- machine direction yarns which are interwoven to form --

Signed and Sealed this

Twenty-ninth Day of April, 2003

JAMES E. ROGAN
*Director of the United States Patent and Trademark Office*